United States Patent [19]

Yanagi

[11] Patent Number: 4,506,612

[45] Date of Patent: Mar. 26, 1985

[54] TESTING DEVICE FOR AN AUTOMATIC SEWING MACHINE

[75] Inventor: Toshiaki Yanagi, Nagoya, Japan

[73] Assignee: Brother Kogyo Kabushiki Kaisha, Nagoya, Japan

[21] Appl. No.: 407,800

[22] Filed: Aug. 13, 1982

[30] Foreign Application Priority Data

Sep. 1, 1981 [JP] Japan ..... 56-137383

[51] Int. Cl.[3] ..... D05B 21/00

[52] U.S. Cl. ..... 112/121.12

[58] Field of Search ..... 112/121.12, 121.11, 112/158 E, 221, 275, 277; 318/567, 569

[56] References Cited

U.S. PATENT DOCUMENTS 4,051,794 10/1977 Herzer et al. ..... 112/121.12
4,135,459 1/1979 Manabe et al. ..... 112/121.12
4,221,176 9/1980 Besore et al. ..... 112/121.12

FOREIGN PATENT DOCUMENTS 2083846B 3/1982 United Kingdom .

*Primary Examiner*—Peter Nerbun
*Attorney, Agent, or Firm*—Browdy and Neimark

[57] ABSTRACT

A testing device for an automatic sewing machine wherein a succession of stitches are formed through variation in relative position between a needle and a work holder according to a batch of positional data stored in a memory. The device comprises a control circuit for controlling to operate stepper motors to effect variation in the relative position without reciprocating movements of the needle. The control circuit includes first control means for varying the relative position every time the positional data for each of the stitches is executed, second control means for varying the relative position every time the positional data for a plural number of the stitches are continuous executed at one time, and a selector for selectively actuating one of the first and second control means to select one of two modes in which the stored positional data are tested for verification.

6 Claims, 8 Drawing Figures

※ 100 STITCH POSITION DATA SUMMED UP, OR END OF DATA?

TESTING DEVICE FOR AN AUTOMATIC SEWING MACHINE

BACKGROUND OF THE INVENTION

The present invention relates to a testing device for a sewing machine capable of forming a succession of stitches or a stitch pattern on a work fabric through relative movements between the needle and work holding means under control of a batch of stitch position data.

In the art of electronically-controlled sewing machines for industrial applications wherein a stitch pattern is formed on the workpiece according to a batch of stitch position data stored in a memory provided in a drive control circuit, it is a common practice that a test run of the machine is conducted prior to starting a sewing operation in order to check if the stitch position data has been programmed without an error and correctly stored in the memory, and check if an intended stitch pattern is exactly formed at a predetermined position on the workpiece retained in a work holder. In such test run, only the work holder is moved according to the programmed data from one stitch position to another with intermittent actions stopping at each stitch position between the sewing start and end points while the needle is kept at rest, whereby the work holder is checked for necessary feed motions thereof to obtain the desired stitch pattern. Such a program testing practice is disclosed in British Patent Application filed in the name of the assignee of the present application, laid open Mar. 31, 1982 under Publication No. GB 2,083,846B.

In such manner of testing operation, however, a lot of time is required to trace a programmed stitch pattern with the intermittent movements of the work holder between adjacent stitches starting at the sewing start position, and consequently the testing operation is time-consuming and less efficient when it is sufficient to check the movements only at selected stitch positions, particularly where the programmed stitch pattern consists of a multiplicity of stitches.

SUMMARY OF THE INVENTION

It is accordingly an object of the present invention to provide a testing device for a sewing machine which permits an efficient testing of a programmed stitch pattern in a reduced period of time.

It is another object of the invention to provide a testing device for a sewing machine which provides two alternatively selectable modes of testing, one mode allowing a work holder to move intermittently from one stitch position of a stitch pattern to the next according to stitch position data for one stitch at one time, and the other mode allowing the work holder to move in a skipping manner from one stitch position to another which is a multiplicity of stitches ahead of said one stitch position while a batch of stitch position data are executed continuously at a time.

According to the invention, there is provided a testing device for an automatic sewing machine wherein a succession of stitches are formed through variation in relative position between a needle and work holder according to a batch of positional data stored in memory means, the testing device comprising:

driving means for varying the relative position; and control means for controlling the operation of the driving means without reciprocating movements of the needle during operation of the testing device, the control circuit including first control means for varying the relative position every time the positional data for each of the stitches is executed, second control means for varying the relative position every time the positional data for a plural number of the stitches are continuously executed at one time, and switching means for selectively actuating the first and second control means.

These and other objects and features of the invention will become more apparent from the following description of preferred embodiments thereof taken in connection with the accompanying drawings.

BRIEF DESCRIPTION OF THE DRAWINGS

The present invention is illustrated in the accompanying drawings in which.

DETAILED DESCRIPTION OF THE PREFERRED EMBODIMENTS

Referring now to the accompanying drawings, there will be described the present invention embodied on a sewing machine.

Figure 1A:
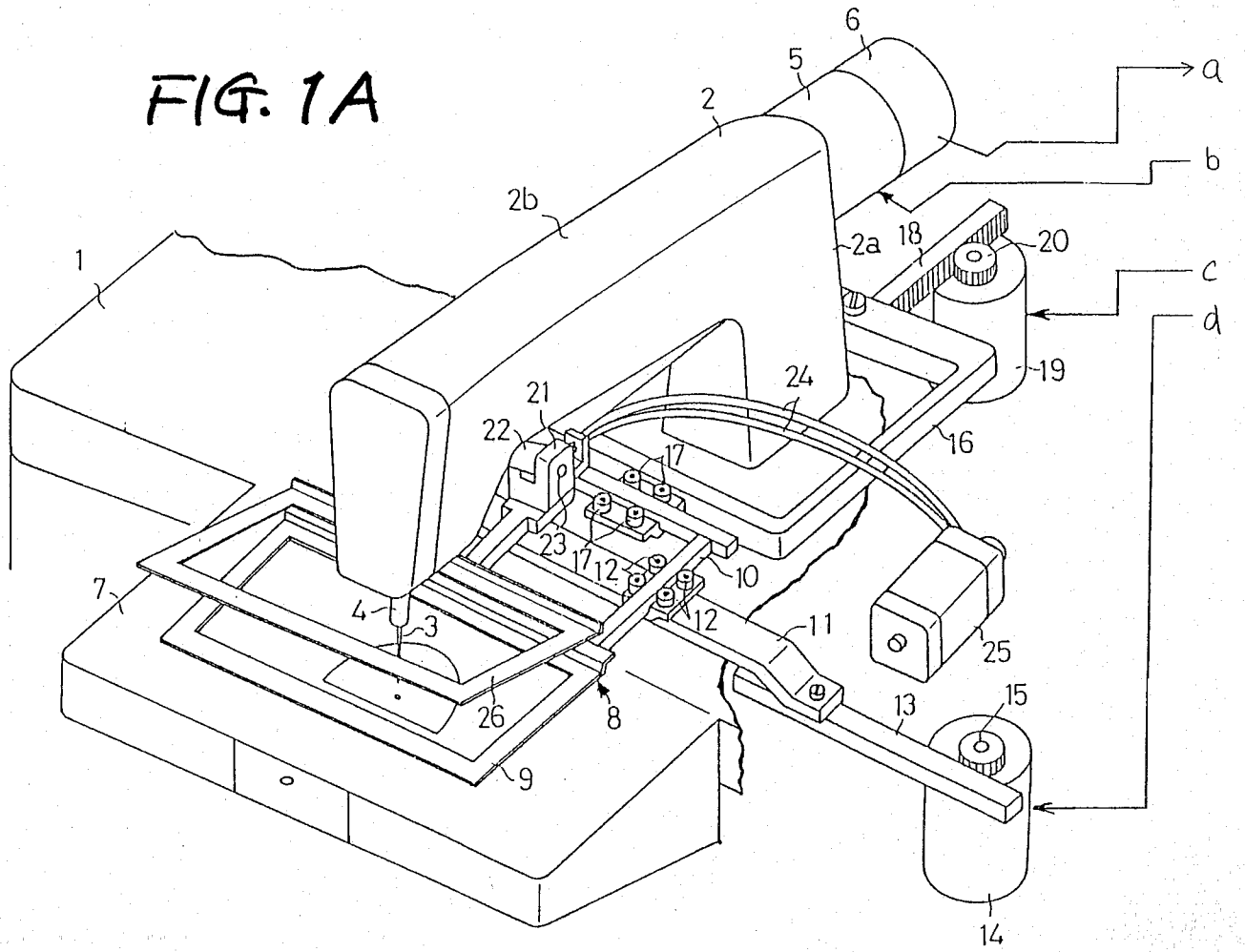
FIG. 1A is a fragmentary perspective view of a sewing machine.

There is shown in FIG. 1A a table 1 of the sewing machine on which is mounted a machine frame 2 which has a standard 2*a* and a bracket arm 2*b* extending toward the front of the machine. The bracket arm 2*b* includes a head portion which is provided with a vertically movable needle bar 4 having at its lower end a needle 3. The head portion is further provided with a vertically movable presser bar (not shown) having at its lower end a presser foot (not shown). There is mounted on the rear side of the bracket arm 2*b* a direct current (DC) drive motor 5 which provides vertical movements of the needle bar 4. Attached to the rear side of the DC drive motor 5 is a needle position detector 6 which detects an angular position, i.e., rotation of a drive shaft of the DC drive motor 5 and generates a detection signal each time the needle 3 is located at a predetermined position, e.g., lowered or lifted position.

There is provided, at the central front of the table 1, a workpiece support bed 7 on which is supported a work holder or holding device 8 which is movable in a horizontal plane across the reciprocating path of the needle 3. The needle 3 and a shuttle hook (not shown) incorporated in the workpiece support bed 7 cooperate to form stitches on a workpiece held by the work holding device 8.

The work holding device 8 comprises a work supporting frame 9 disposed on the workpiece support bed 7. The work supporting frame 9 is fixed at the rear to a feed frame 10 which is supported movably in both lateral (X) and cross (Y) directions, i.e., along the X and Y axes of the machine.

The feed frame 10 is operatively coupled to a connecting member 11 which is supported movably only in the lateral direction and which carries guide rollers 12 engaging two opposite sides of the feed frame 10. The guide rollers 12 permit the feed frame 10 to move in the cross direction. The connecting member 11 is connected, at its right-hand side end as viewed in FIG. 3, to a rack 13 which engages a pinion 15 fixed to a drive shaft of an X-axis pulse or stepper motor 14, whereby the feed frame 10 is moved, via the rack 13 and the connecting member 11, to the left as viewed in FIG. 1A, i.e., in the positive X (+X) direction when the stepper motor 14 is operated in one direction, and to the right, i.e., in the negative X (−X) direction when it is operated in the other or reverse direction.

The feed frame 10 is operatively coupled further to a connecting frame 16 which is supported movably only in the cross (Y) direction and which carries guide rollers 17 engaging the rear side of the feed frame 10. The guide rollers 17 permit the feed frame 10 to move in the lateral (X) direction. The connecting frame 16 is connected, at its rear side, to a rack 18 which engages a pinion 20 fixed to a drive shaft of a Y-axis pulse or stepper motor 19, whereby the feed frame 10 is moved, via the rack 18 and the connecting frame 16, toward the rear, i.e., in the negative Y (−Y) direction when the stepper motor 19 is operated in one direction, and toward the front, i.e., in the positive Y (+Y) direction when it is operated in the other direction. With this construction, the forward and reverse rotation of the X-axis and Y-axis stepper motors 14 and 19 will cause the work supporting frame 9 to move in the lateral and cross directions thereby allowing any point within the supporting frame 9 to be brought into alignment with the needle 3 or located at a needle lowering position (hereinafter simply called "needle position") in the horizontal plane.

There is fixed to the feed frame 10 a block 21 which has a pivot arm 22 connected thereto pivotally about a support pin 23. The base or supported end portion of the pivot arm 22 is coupled to a drive motor 25 through two wires 24 so that the pivot arm 22 is pivoted via the wires 24 in upward and downward directions upon rotation of the drive motor 25 in opposite directions. To the free or distal end portion of the pivot arm 22, is operatively connected a presser frame 26 which has the same configuration and size as the work holder frame 9. The presser frame 26 cooperates with the work supporting frame 9 to retain the workpiece therebetween when the pivot arm 22 is pivoted downwardly.

There is described next an electric circuit of a testing device of the invention provided on the above sewing machine.

Figure 1B:
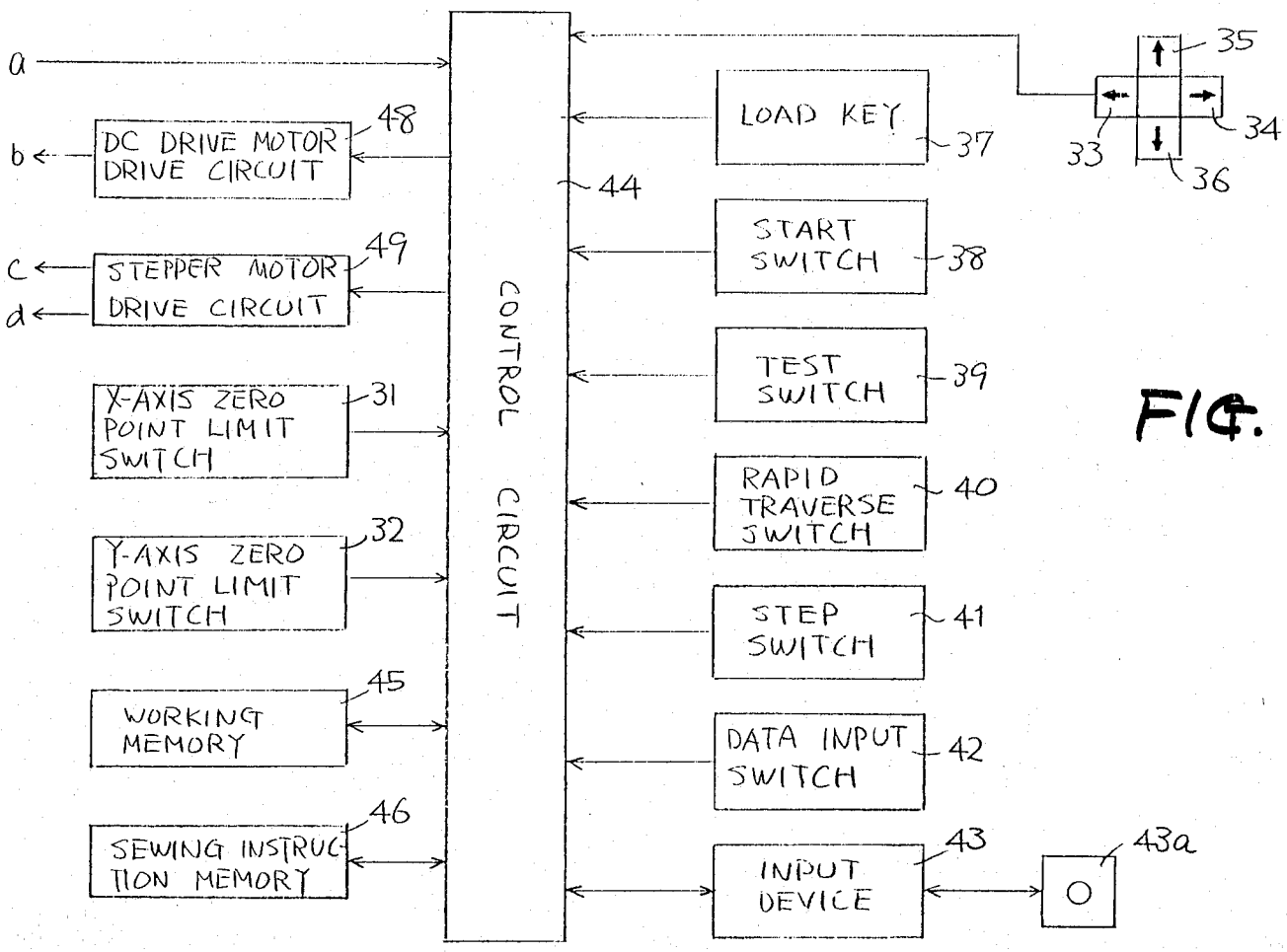
FIG. 1B is a block schematic diagram of a control circuit associated with one embodiment of the invention.

In FIG. 1B, there is shown an X-axis zero point limit switch 31 which is disposed in the proximity of a reciprocating motion path of the previously described rack 13. The limit switch 31 generates an ON signal upon engagement of its movable actuator piece with the rack 13 when the inner edge of the left-hand side of the work supporting frame 9 (as viewed in FIG. 1A) is located at the needle position as a result of a rightward movement of the rack 13 by the X-axis stepper motor 14. Similarly, a Y-axis zero point limit switch 32 is disposed in the proximity of a reciprocating motion path of the previously described rack 18. The limit switch 32 generates an ON signal upon engagement of its movable actuator piece with the rack 18 when the inner edge of the rear side of the work supporting frame 9 is located at the needle position as a result of a forward movement of the rack 18 by the Y-axis stepper motor 19.

There are provided, on a program control console (not shown), X- and Y-axis jog keys 34, 35, 36 and 37 which are automatically resettable and produce, when pressed, pulse signals to move the work holding device 8 in corresponding direction. More specifically, pressing one of the X-axis jog keys 33 will cause the work holding device 8 to move to the left as seen in FIG. 1A. On the other hand, pressing the other X-axis jog key 34 will cause the same device 8 to move to the right. Similarly, the device 8 is moved toward the rear when one of the Y-axis jog keys 35 is pressed, while it is moved toward the front when the other Y-axis jog key 36 is pressed. There is also provided on the program control console an automatically resettable load key 37 which, when pressed, produces an ON signal that causes a later described working memory 45 to store position data associated with each stitch position established by manipulating the X- and Y-axis jog keys 33 through 36.

A start switch 38 which is also automatically resettable is provided in operative connection with a pedal (not shown) located under the sewing machine. The start switch 38 generates an ON signal when the pedal is depressed. There is provided on a control panel (not shown) on the front side of the sewing machine a test switch 39 of holding type which generates, when actuated, an ON signal causing the work holding device 8 to move in a test mode. A rapid traverse switch 40 which is also automatically resettable, will generates an ON signal when it is actuated during the test mode operation performed at a predetermined normal speed, which signal causes an increase in the feed speed at which the work holding device 8 is moved in the test mode from one stitch position to the next in an intermittent manner stopping at each stitch position.

There is also provided on the control panel a step switch 41 of automatic resetting type which is designed as test mode selecting means. When this step switch 41 is actuated, it generates an ON signal which will change the test mode of the machine from the first test mode to the second test mode. In the first test mode, the work holding device 8 is moved with intermittent actions travelling a stitch-to-stitch distance in each action from one stitch position to the next, as described above. In the second test mode, the device 8 is moved also with intermittent actions but skipping or stepping over from one stitch position to another which is a multiplicity of stitches (100 stitches in this specific embodiment) apart from the said one position. A data input switch 42 which is also automatically resettable and provided on the control panel, will generate, when actuated, an ON signal which causes stitch pattern forming position data registered in a floppy disc **43*a* to be transferred into a later described sewing instruction memory 46 via an input device 43**.

A control circuit 44 including a central processing unit (CPU) receives the ON signals from the respective switches 31, 32 and 38 through 42, and the ON signals from the keys 33 through 37 and the detection signal from the needle position detector 6, and are adapted to control, according to those signals: operation to actuate the DC drive motor 5 and the work holding device 8; the first test mode operation to move the work holding device 8 with intermittent actions stopping at each stitch position; the second test mode operation to move the work holding device 8 with jumping or skipping actions over a multiplicity of stitches; and other operations.

Figure 2:
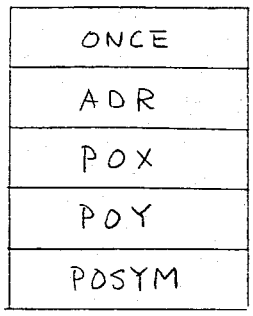
FIG. 2 is a view showing data storage areas of a working memory connected to the control circuit.

The previously indicated working memory 45 is a random access memory which has the following memory areas as indicated in FIG. 2: an area in which is stored data ONCE representing whether or not the work holding device 8 has been once returned to the absolute zero point or home position (whether or not the inner edge of the rear left corner of the work holder frame 9 has been located at the needle position); an area in which is stored data ADR representing that address of the later described sewing instruction memory 46 from which stitch position data is read out; an area in which is stored data POX representing the number of steps of the X-axis stepper motor 14 corresponding to a distance of lateral movement (covering 100 stitches) of the work holding device 8 in each motion during the second test mode of operation; an area in which is stored data POY representing the number of steps of the Y-axis stepper motor 19 corresponding to a distance of cross movement (covering 100 stitches) of the work holding device 8 in each motion during the second test mode of operation; and an area in which is stored data POSYM representing rotating directions of the X- and Y-axis stepper motors 14 and 19 (positive or negative direction in which the work holding device 8 is moved along the X and Y axes; rightward or leftward and forward or backward).

Figure 3:
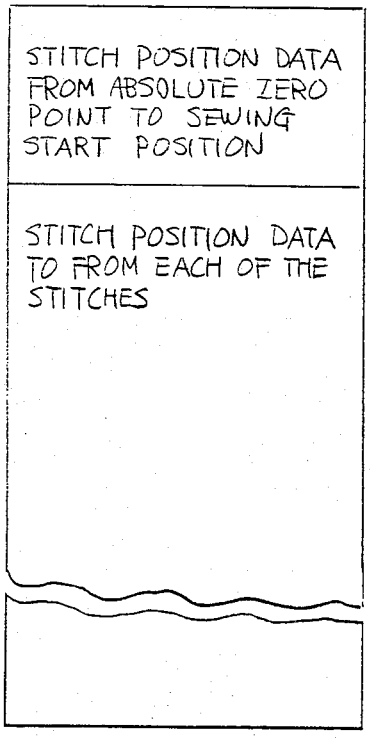
FIG. 3 is a view showing data storage areas of a sewing instruction memory connected to the control circuit.
Figure 5:
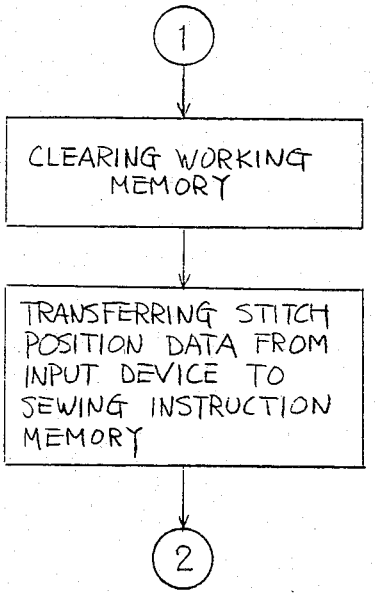
Figure 6A:
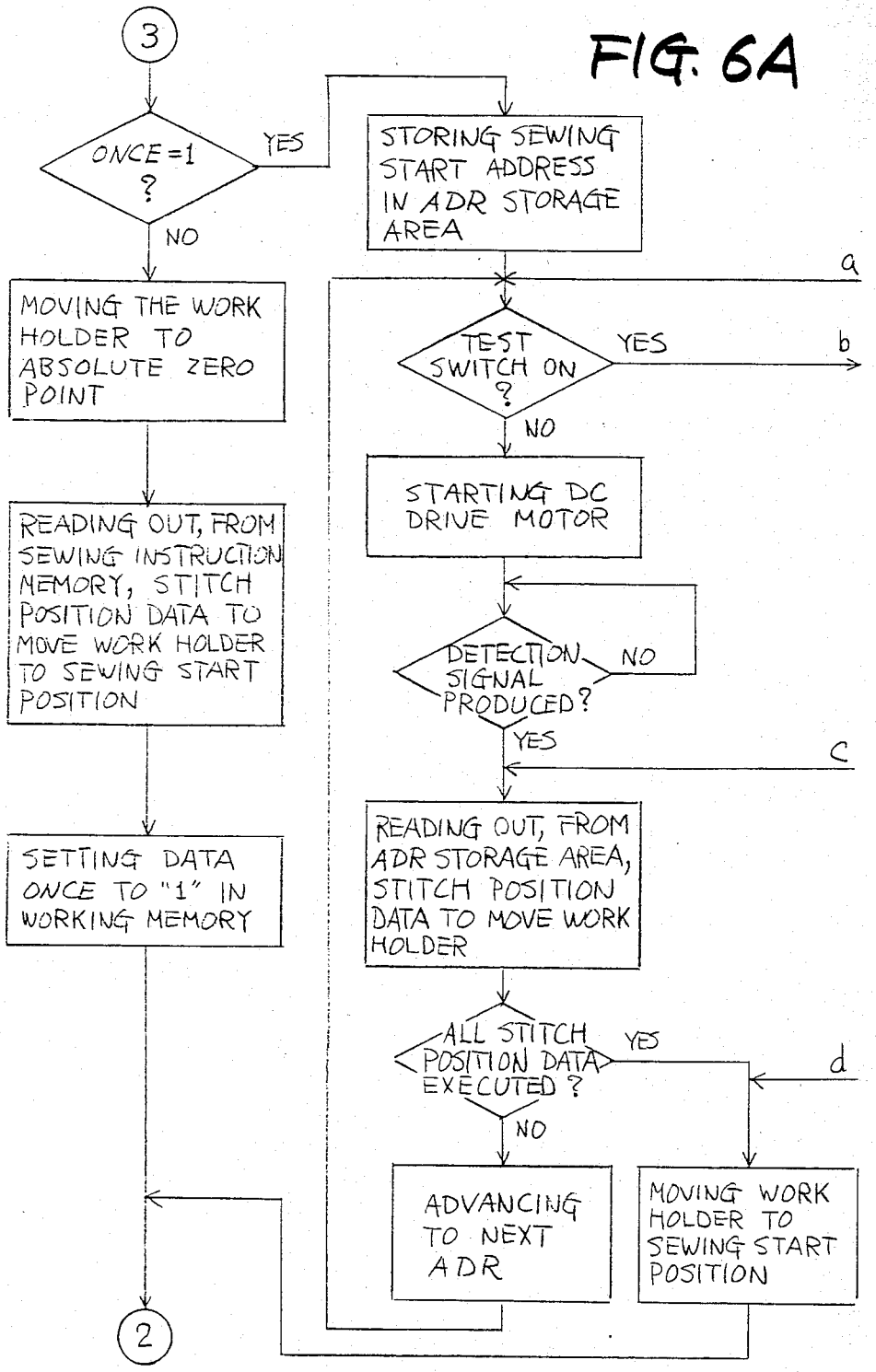
Figure 6B:
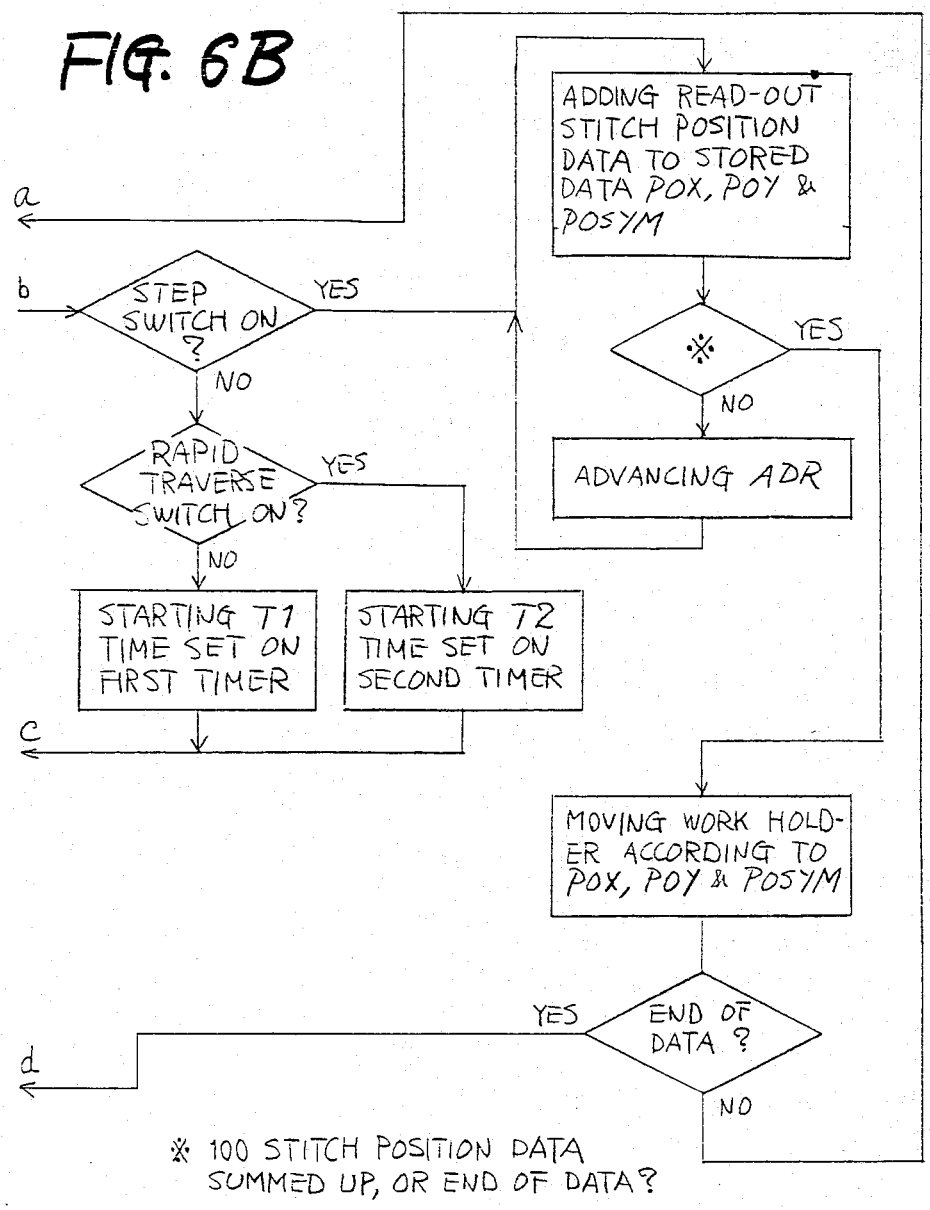

The sewing instruction memory 46 which is also a random access memory, sequentially stores, at its respective addresses, stitch position data associated with each of the stitches forming a stitch pattern, as indicated in FIG. 3. The stitch position data consists of data X and Y representative of the number of steps of the X- and Y-axis stepper motors 14 and 19, and data SYM representative of the rotating directions of those motors.

A stepper motor drive circuit 49 directs the X- and Y-axis stepper motors 14 and 19 to operate a selected number of steps in a selected direction in response to the drive control signals generated from the control circuit 44. Similarly, a DC motor drive circuit 48 starts and stops the DC drive motor 5 in response to the drive control signals from the control circuit 44.

Referring to FIGS. 4, 5, 6A and 6B which are flow charts associated with the control circuit 44, the operation of the sewing machine constructed as previously disclosed will be described.

Figure 4:
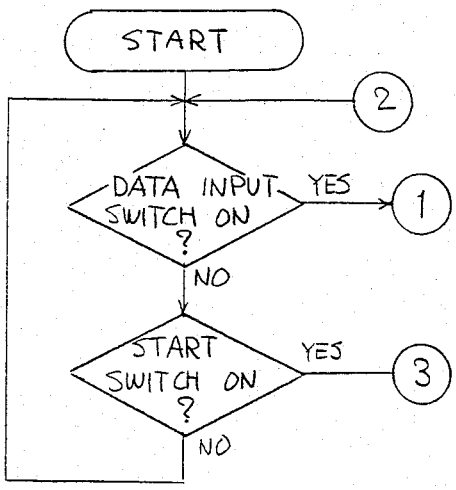
FIGS. 4, 5, 6A, and 6B are flow charts illustrating arithmetic and processing operations of the control circuit.

When a power on-off switch (not shown) of the sewing machine is turned on, the control circuit 44 will become ready to accept ON signals from the data input switch 42 and the start switch 38, as indicated in the flow chart of FIG. 4. Upon turning on the data input switch 42, the control circuit 44 will operate in the sequence as shown in the flow chart of FIG. 5. In more detail, the working memory 45 is fully cleared, and then the stitch position data for all stitches forming a stitch pattern which are stored in the floppy disc 43*a* and supplied from the input device 43 are transferred to respective addresses of the sewing instruction memory 46.

After all stitch position data to form the stitch pattern and stored in the floppy disc 43*a* have been transferred to the sewing instruction memory 46, the machine operator turns on the test switch 39 and depress the pedal to turn on the start switch 38 in order to run the machine in a test mode according to the stored stitch position data. When the start switch 38 has been turned on, the control circuit 44 will follow the sequence indicated in the flow chart of FIG. 6: More specifically, the circuit 44 first checks the data ONCE in the working memory 45 to see whether the work holding device 8 has been returned to the absolute zero point, and if the data ONCE is found to be "0", the circuit 44 then presents drive control signals to the stepper motor drive circuit 49 so that the stepper motors 14 and 19 are operated to locate the work holding device 8 at the absolute zero point. As soon as the work holding device 8 has been located at the absolute zero point, the X-axis and Y-axis zero point limit switches 31 and 32 are both actuated and generate ON signals. In response to these ON signals from the limit switches, the control circuit 44 reads out, from the sewing instruction memory 46, the stitch position data to move the work holding device 8 from the absolute zero point to the sewing start position, whereby the drive control signals are fed to the stepper motor drive circuit 49 to bring the work holding device 8 to the sewing start position. When the device 8 has been located at the start position, the control circuit 44 sets the data ONCE in the working memory 45 to "1" and waits for operation of the next depression of the pedal.

When the start switch 38 is turned on with the pedal again depressed, the control circuit 44 recognizes that the data ONCE in the working memory 45 is "1", then registers in the ADR area of the memory 45 the address of the sewing instruction memory 46 at which is stored the sewing start data (data to form the first stitch starting at the sewing start position, stored in the memory 46 whose addresses are assigned to stitch position data for each of the stitches), and then starts the test mode of operation if the test switch 39 is found to be ON.

Since the step switch 41 and the rapid traverse switch 40 have not been turned on at this time, the test operation is performed in the first test mode wherein the work holding device 8 is moved at the normal speed. In other words, the control circuit 44 reads out the stitch position data from the address of the sewing instruciton memory 46 registered in the ADR area of the working memory 45, only after a time T1 set on a first timer in the circuit 44 has elapsed or the first timer has timed out. Thus, the movement of the work holding device 8 according to the stitch position data is commenced after a lapse of the preset time interval T1.

Upon completion of the movement of the work holding device 8 according to the read-out stitch position data, the control circuit 41 checks for presence of any stitch position data left in the sewing instruciton memory 46 and then advance or increment the address data ADR in the working memory 45 so as to read out the next stitch position data, if any. In the same manner, the stitch position data in the sewing instruction memory 46 are read out at the preset time interval T1, and the work holding device 8 is moved according to those data read from the memory 46.

If the rapid traverse switch 40 is turned on during this test mode of operation, the control circuit 44 will actuate a second timer incorporated therein. After a lapse of a time interval T2 preset on the second timer which is shorter than the time interval T1 preset on the first timer, i.e., after the second timer has timed out, the control circuit 44 reads out the stitch position data from the address of the sewing instruciton memory 46 registered in the ADR area of the working memory 45, and moves the work holding device 8 according to the read-out data. In this condition, the stitch position data is read out in a shorter period of time whereby the speed at which the work holding device 8 is moved from one stitch position to the next is accordingly increased.

After completion of the movement of the work holding device 8 according to all of the stitch position data stored in the sewing instruction memory 46, the control circuit 44 will cause the work holding device 8 to move back to the sewing start position and terminate the first test mode of operation.

If the step switch 41 is turned on before a test mode of operation is started or during the first test mode of operation, the control circuit 44 will initiate the operation in the second test mode following the sequence shown in the flow chart of FIG. 6. In response to the actuation of the step switch 41, the control circuit 44 reads out the stitch position data from the address of the sewing instruction memory registered in the working memory 45, and stores the read-out data in the respective memory 46 areas of the memory 45. Since the circuit 41 recognizes that the stitch position data for a succession of 100 stitches have not yet been read out from the sewing instruction memory 46, the circuit 44 will advance or increment the address data ADR in the working memory 45 in order to read out the next stitch position data. When the address data ADR has been incremented, the control circuit 44 will read out the stitch position data from the address of the sewing instruction memory 46 corresponding to the newly established address in the working memory 45, and add the newly read data to the already stored data in the respective areas of the working memory 45 in order to store the summed values in those memory areas. These steps of operation are repeated until the stitch position data for a total of 100 stitches have been summed up in each of the memory areas of working memory 45. That is, the working memory has the following data in the respective areas: POX representing the total number of steps of the X-axis stepper motor 14; POY representing the total number of steps of the Y-axis stepper motor 19; and POSYM representing the directions of rotation of the X- and Y-axis stepper motors 14 and 19.

Upon termination of the adding operation of the stitch position data for the succession of 100 stitches, the control circuit 44 will cause the work holding device 8 to move directly to the stitch position which is 100 stitches ahead of the current stitch position, according to the summed data POX, POY and POSYM stored in the working memory 45, without stopping at each stitch position. In the same way, the control circuit 44 sums up the stitch position data for the next succession of 100 stitches and moves the work holding device 8 to the stitch position which is located 100 stitches further ahead of the last position. Thus, the same operation is repeated so that the work holding device 8 is intermittently moved over a distance corresponding to 100 stitches at one time.

When all of the stitch position data in the sewing instruction memory 46 have been read and executed and the work holding device 8 has been moved to the last stitch position, the control circuit 44 will direct the device 8 to move back to the sewing start position and terminate the second test mode of operation.

In the event that the step switch 41 is turned off during the second test mode of operation, the control circuit 44 will immediately change the operation from the second test mode to the first test mode.

At the end of the first or second test mode of operation, the test switch 39 is turned off and the pedal is depressed to turn on the start switch 38. With the start switch turned on, the control circuit 44 supplies drive control signals to the DC motor drive circuit 48 to start the DC drive motor 5 thereby initiating a sewing operation according to the stitch position data stored in the sewing instruction memory 46. In response to a detection signal produced from the needle position detector 6 when the needle 3 is lifted above the surface of the work holding device 8 through actuation of the DC drive motor 5, the control circuit 44 reads out stitch position data from the sewing instruction memory 46 and moves the work holding device 8 to the next stitch position according to the read-out data, whereby the device 8 is moved from one stitch position to another to form a succession of stitches on the work fabric along a predetremined seam line.

As previously described, the present embodiment of the invention permits intermittent movements of the work holding device 8 over a distance of 100 stitches at one time for testing the programmed sewing operation without having to stop the feed motion at each stitch position, by simply turning on the step switch 41. Thus, the time required for a testing operation is reduced and the sewing operation is tested in an efficient manner.

Although the invention has been described in its preferred form with a certain degree of particularity, it is understood that the present disclosure of the preferred form has been changed without departing from the scope of the invention as hereinafter claimed.

For example, while each of the intermittent movements of the work holder 8 in the second test mode covers 100 stitches in the above embodiment, the signle movement may cover 20, 30, 50, 200 or any desired number of stitches. As another example, the stitch position data which are stored in the sewing instruction memory 46 from the floppy disc 43*a*, may be prepared by moving the work holder 8 carrying a record medium or pattern record sheet by operating the jog keys 33–36 so that a stitch pattern recorded on the pattern sheet is traced from one stitch position to another by the needle 3, i.e., the work holder is moved a stitch-to-stitch distance at a time so as to align the stitch positions with the needle position. The prepared data for each of the stitches forming the stitch pattern is stored in the sewing instruction memory 46 by turning on the load key 37 at the end of the movement from one stitch position to the next.

What is claimed is:

1. A testing device for an automatic sewing machine wherein a succession of stitches are formed through variation in relative position between a needle and a work holder according to a batch of positional data representing positions of said stitches and stored in memory means, said testing device comprising:

drive means for varying said relative position; and control means for controlling the operation of said driving means without reciprocating movements of said needle during operation of said testing device in one of a first test mode and a second test mode, said control means including first control means, operable in said first test mode, for executing said positional data for only one of said stitches at one time, to intermittently move said work holder from one stitch position to the next, second control means, operable in said second test mode, for processing said positional data for a predetermined plural number of successive ones of said stitches, to continuously move said work holder at one time from one stitch position to another which is ahead of said one stitch position by said plural number of stitches, and switching means for selectively actuating said first or second control means to test said batch of positional data in the corresponding first or second test mode.

2. A testing device according to claim 1, wherein said driving means includes a pair of stepper motors.

3. A testing device according to claim 1, wherein said first control means includes selecting means for selecting a time interval at which said positional data are intermittently read out from said memory means for changing the speed of said variation in relative position.

4. A testing device according to claim 3, wherein said selecting means for selecting said time interval includes:

first setting means for setting said time interval;

second setting means for setting a time interval different from said time interval set by said first selecting means, and manual selector switch for selectively actuating said first and second setting means.

5. A testing device according to claim 1, wherein said second control means includes means for effecting an addition to sum up said positional data for said plural number of stitches, and means for outputting the summed positional data.

6. A testing device according to claim 1, wherein said switching means includes a manual selector switch normally set in a position at which said first control means is operated.

* * * * *